US008191178B2

(12) United States Patent
Mangel, Jr.

(10) Patent No.: US 8,191,178 B2
(45) Date of Patent: Jun. 5, 2012

(54) HELMET-MOUNTED MOUTH GUARD HOLDER

(76) Inventor: Hal Mangel, Jr., Pittsburgh, PA (US)

( * ) Notice: Subject to any disclaimer, the term of this patent is extended or adjusted under 35 U.S.C. 154(b) by 298 days.

(21) Appl. No.: 12/475,639

(22) Filed: Jun. 1, 2009

(65) Prior Publication Data

US 2010/0138981 A1 Jun. 10, 2010

Related U.S. Application Data

(60) Provisional application No. 61/119,887, filed on Dec. 4, 2008.

(51) Int. Cl.
*A42B 1/24* (2006.01)

(52) U.S. Cl. ..... 2/422; 2/425; 2/410; 2/9

(58) Field of Classification Search ..... 2/422, 425, 2/410, 9, 6.2, 6.6, 6.7, 209.13; 224/181
See application file for complete search history.

(56) References Cited

U.S. PATENT DOCUMENTS 3,139,624 A * 7/1964 Humphrey ..... 2/9
3,407,809 A * 10/1968 Ross ..... 128/861
3,448,738 A * 6/1969 Berghash ..... 128/861
3,682,164 A * 8/1972 Miller ..... 128/857
4,774,729 A * 10/1988 Coates et al. ..... 2/424
4,791,941 A 12/1988 Schaefer
5,234,005 A 8/1993 Kittelsen et al.
5,353,810 A 10/1994 Kittelsen et al.
5,365,946 A 11/1994 McMillan
6,047,400 A 4/2000 Spencer
6,497,493 B1 * 12/2002 Theisen ..... 362/105
6,616,294 B1 * 9/2003 Henry ..... 362/106
6,647,554 B1 * 11/2003 Yan ..... 2/209.13
6,941,952 B1 * 9/2005 Rush, III ..... 128/861
7,240,376 B2 7/2007 Ide et al.
2002/0010958 A1 * 1/2002 Schiebl et al. ..... 2/413
2003/0093853 A1 * 5/2003 Maloney ..... 2/425
2008/0092277 A1 4/2008 Kraemer et al.
2009/0210999 A1 * 8/2009 Faron-French ..... 2/422

* cited by examiner

*Primary Examiner* — Gary L Welch
*Assistant Examiner* — Andrew W Collins
(74) *Attorney, Agent, or Firm* — McKay & Associates, P.C.

(57) ABSTRACT

Disclosed is a mouth guard or mouth piece holder having a pair of mounts each mount having a generally concave back surface and a flat front surface and configured to be fixed to an exterior surface of a helmet with the back surface conforming to and abutting the exterior surface of the helmet. A face plate is attached to the mounts to define a pocket. A support base is medially located within the pocket formed integral to the bottom edge of the face plate to partially fill the pocket. Thus, the pocket with the base is adapted to accommodate the mouth guard such that the mouth guard can be maintained proximate to the exterior surface of the helmet above the facemask during temporary periods of non-use.

8 Claims, 2 Drawing Sheets

HELMET-MOUNTED MOUTH GUARD HOLDER

SPECIFIC REFERENCE

The instant application claims benefit of provisional application Ser. No. 61/119887, filed Dec. 4, 2008.

BACKGROUND

1. Field of the Invention

The instant invention relates to mouth guards used by athletes and implements for securing the mouth guards to helmets or facemasks.

2. Description of the Related Art

Mouth guards or mouth pieces used to protect the teeth of athletes are known in the art. As it relates to American football, the mouthpieces typically are tethered such that they can be wrapped around and fastened to the face mask of the helmet. When not in use the mouth guards are pulled out and hang from the face mask. As is known in the art, mouthpieces including tethers are either adapted to be looped at their ends and fastened to itself around the facemask, or the tether can be fastened directly to the face mask. For instance, in U.S. Pat. No. 3,448,738 to Berghash the protective mouthpiece has a bulb and loop at its end, and the bulb loops into the end of the tether. In Kittelsen et al. (U.S. Pat. No. 5,353,810) the wishbone end of the tether is anchored to the facemask. These types of mouth guards can be quite expensive and typically are not used by budget-constrained football programs, such as in high school. Programs for younger athletes may not even provide mouthpieces, but require the student-athletes to purchase them independently. This results in a wide-variety of different mouth guards being used, some of which do not include tethers or fastening means. Thus, for mouth pieces which do not include tethers, athletes must hold the mouth guards upon removal from the mouth, or insert the mouth guards snugly between the rows forming the face-mask. As is known in the art, a mouthpiece without a tether is simply wedged in between the bars of the facemask. Among other problems, this can be unsanitary and the mouth guards can easily be lost during the event leading to safety and additional expense issues. Furthermore, most helmet facemasks are not designed for this particular purpose, especially when the helmets and facemasks are non-traditional or used for sports other than football.

There is a need then for a mouth guard securing device well-suited for non-tethered mouth guards which is adapted to accessibly situate the mouth guard directly on the helmet.

SUMMARY

It is the objective of the instant invention to provide a mouth guard holder which can be used to secure a mouth guard in lieu of having to use an American football facemask.

It is further the objective of the instant invention to provide a mouth guard holder which can be used to secure non-tethered mouth guards.

It is further the objective of the instant invention to provide a mouth guard holder which can be used on a variety of helmets and for a variety of sports.

It is further the objective of the instant invention to provide a mouth guard holder which allows a wearer quick and easy placement and access to the mouthpiece.

It is further the objective of the instant invention to maintain the aesthetic of the traditional American football helmet.

Thus, the invention comprehends a mouth guard holder having a pair of mounts, each mount having a generally concave back surface and a flat front surface and configured to be fixed to an exterior surface of a helmet with the back surface conforming to and abutting the exterior surface of the helmet. A face plate having a bottom edge and two ends and a medial portion is connected to the flat front surface, the medial portion being preferably non-coplanar with each end to jut outwards away from each end (the plane defined by the front surfaces of each mount to define a pentagonal shaped pocket). Then a support base is medially located within the pocket formed integral to the bottom edge of the face plate to partially fill the pocket. Thus, the pocket and the base are adapted to accommodate the mouth guard such that the mouth guard can be maintained proximate to the exterior surface of the helmet during temporary periods of non-use.

DETAILED DESCRIPTION OF THE PREFERRED EMBODIMENT

The invention will now be described in detail in relation to a preferred embodiment and implementation thereof which is exemplary in nature and descriptively specific as disclosed. As is customary, it will be understood that no limitation of the scope of the invention is thereby intended. The invention encompasses such alterations and further modifications in the illustrated assembly, and such further applications of the principles of the invention illustrated herein, as would normally occur to persons skilled in the art to which the invention relates. This detailed description of this invention is not meant to limit the invention, but is meant to provide a detailed disclosure of the best mode of practicing the invention.

Figure 1:
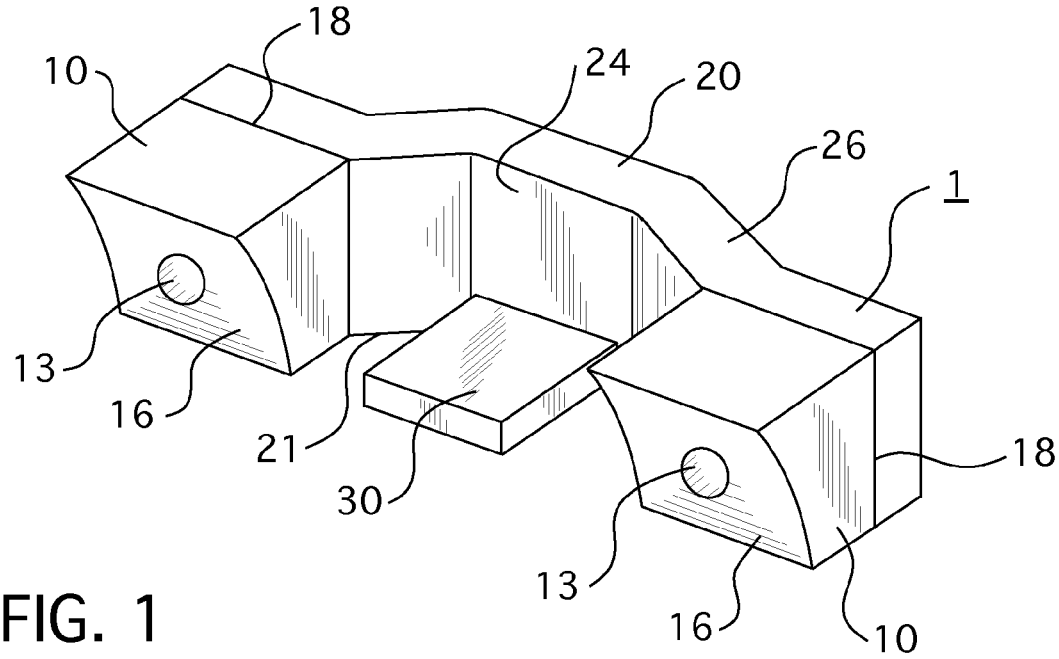
FIG. 1 shows a rear perspective view of the instant invention.
Figure 2:
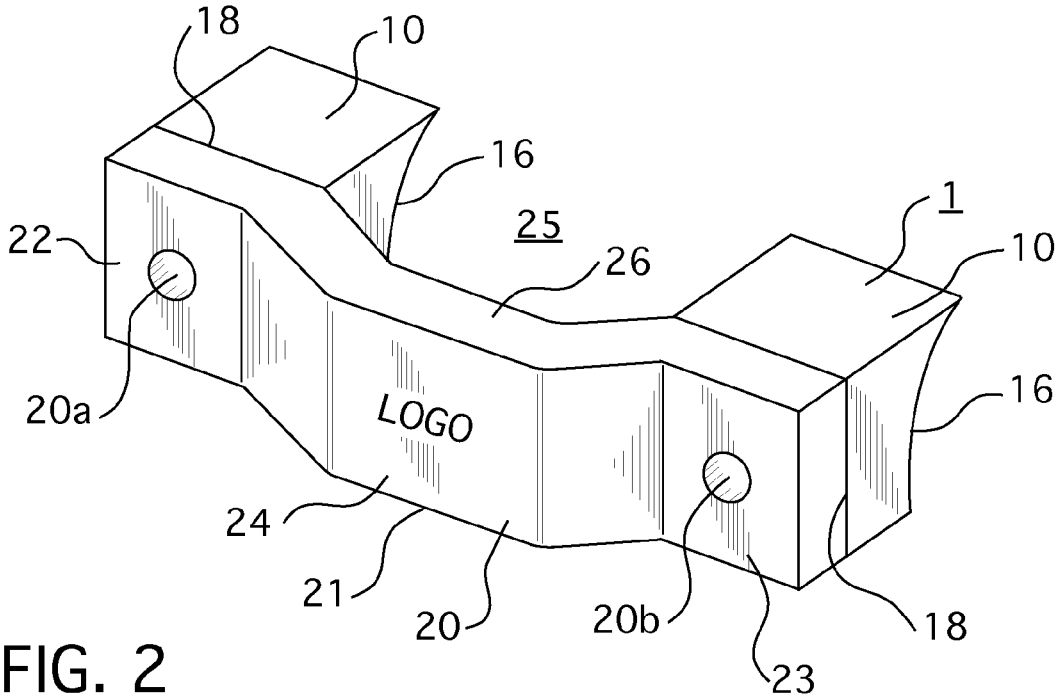
FIG. 2 shows a front perspective view of the instant invention.
Figure 3:
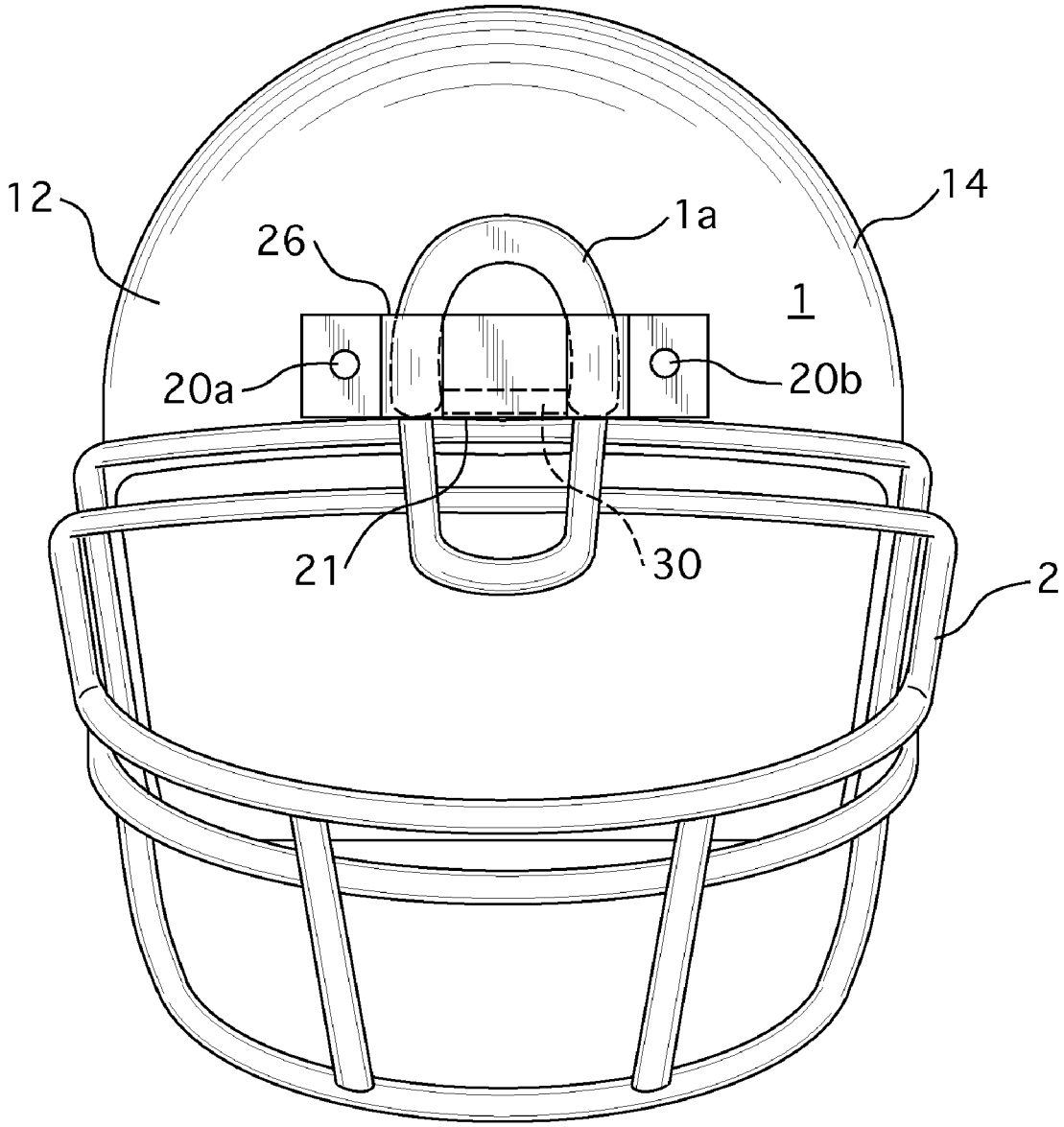
FIG. 3 shows a front elevation view of the instant invention in use on an American football helmet.

With reference then to FIGS. 1-3, shown is a mouth guard holder 1 adapted to be mounted to the front of a helmet 14 to temporarily situate a mouthpiece 1*a* (mouth guard), preferably directly above the facemask 2 similar to the helmet-maker label, which typically is situated medially on the helmet 14 above the top rung of the facemask 2.

A pair of mounts 10 are configured to be affixed to the exterior surface 12 of the helmet 14. Each mount 10 is generally cuboidal in shape (six rectangular faces), "generally" referring to the exception that it has a deformable or a concave back surface 16 opposite its rectangular flat front surface 18. Each mount 10 can be made of a hard rubber or rigid composite. When the mounts 10 are made of rubber, when fastened to and abutting the helmet 14 the back surface 16 is deformable and will bend or give slightly to conform to the exterior surface 12 of the helmet 14. When the mounts are made of a rigid or semi-rigid composite, "concave" refers to, of the six surfaces defining the cuboid, this particular back surface 16 is not flat but pre-formed to the slight curvature of the helmet 14. The mounts 10 are preferably fixed to the front exterior surface 12 of the helmet 14 using screws or rivets driven through central holes 13 within each mount and through the outer shell of the helmet 14, as further described below in conjunction with the face plate 20. As above, the back surface 16 is generally concave (or adapted to bend or collapse if made of rubber) to conform to the slight curvature of the front of the helmet 14. Aesthetically, in the preferred embodiment the mounts 10 are spaced such that the central holes 13 of each mount 10 are aligned with the holes which traditionally secure the label of the helmet 14.

The face plate 20 has a medial portion 24, a bottom edge 21 and two ends 22, 23. The face plate 20 is preferably made of plastic or similar rigid, lightweight composite material. Each end 22, 23 is connected to one of the mounts 10 such that face plate 20 spans the distance defined by the mounts 10 to define a pocket 25 within which the mouthpiece 1*a* can be situated. Face plate 20 includes a pair of plate holes 20*a* and 20*b* defined within ends 22, 23 which are aligned with central holes 13 of each mount 10 so that the screws or rivet or other fastening means can secure the holder 1 to the helmet 14 as the screw or rivet passes through plate holes 20*a*, 20*b*, through mount central holes 13 and into exterior surface 12 of helmet 14. In the preferred embodiment, plate holes 20*a*, 20*b* are spaced a distance equal to the distance between pre-existing helmet facemask 2 holes such that the holder 1, when mounted through the equally spaced mount central holes 13, acts as a substitute for a helmet-maker label, as above. As a substitute for the helmet-maker label then, the instant invention is well-suited to have the helmet brand or logo directly on the face plate 20 outwardly displayed.

To further provide enough space to contain the mouth guard 1*a* but not so much as to attract grass and mud from a playing field, the medial portion 24 of the face plate 20 is non-coplanar with each end 22, 23, meaning medial portion 24 juts slightly outwards away from the helmet 14 surface and away from the plane defined by the ends 22, 23 of the face plate 20. This helps the instant invention maintain a lower profile on the surface of the helmet 14 while still defining enough pocket 25 to contain the mouth guard 1*a*, the pocket 24 thus being pentagonal in definition when mounted for the preferred embodiment (although a circular or oval configuration of the pocket would suffice).

A mouthpiece seat or support base 30 is medially located within the pocket 25 of the holder 1 at the bottom edge 21 of the face plate 20 between each mount 10, preferably formed integral to the medial portion 24 of face plate 20 along the bottom edge 21. Acting as a partial "fill" for the pocket 25 of the holder 1, this support base 30 provides a support surface for the mouthpiece 1*a* when the mouthpiece 1*a* rests in the pocket 25. Preferably the support base 30 is sized with a width that does not enclose the pocket 25 but still allows the mouthpiece 1*a* to be situated within the pocket 25, i.e. the support base 30 is not integral with the bottoms of the mounts 10 so as to completely enclose the pocket 25 since a large fill could increase the weight of the holder 1 and therefore impact the weight and feel of the helmet 14 on the user's head. Although preferably the width of the support base 30 is sized less than or equal to the width of medial portion 24, the height of the support base 30 may vary, for instance traveling up to or near the top edge 26 of face plate 20.

In use then and with particular reference to FIG. 3, when an athlete user temporarily removes the mouth guard 1*a* from his or her mouth, the user can place the mouth guard 1*a* within the holder 1, for instance during the huddle or on the sideline. Because the mouth guard 1*a* is generally U-shaped, the two ends of the mouth guard 1*a* are typically in partial contact with the support base 30 such that the mouth guard 1*a* is oriented vertically. In this manner the rounded end of the mouth guard 1*a* projecting upwards from the pocket 25 can be quickly accessed and grabbed for use. The pocket 25 may also simply contain one part of the mouth guard I a as the other half of the mouth guard hangs over the side. Thus, the mouth guard securing device is well-suited to accessibly situate the mouth guard directly on the helmet during temporary periods of non-use e.g. between plays, quarters) or intermissions.

I claim:

1. In combination with a U-shaped mouthguard for a wearer's mouth and a helmet of type having a facemask mounted thereto, the improvement which comprises:

a means for holding said U-shaped mouthuard at a front exterior surface of said helmet medially located above a top rung of said helmet, further comprising pair of mounts, each said mount generally cuboidal in shape having a concave back surface and a flat front surface and configured to be fixed to said front, exterior surface of said helmet with each said back surface conforming to and abutting said front, exterior surface of said helmet;

a face plate having a bottom edge and two ends and a medial portion, each said end connected to each said flat front surface of each said mount such that said face plate spans the distance of said mounts to define a pocket over said top rung of said facemask at said front, exterior surface, said medial portion non-coplanar with each said end to jut outwards away from each said end; and, a support base medially located within said pocket formed integral to said medial portion at a bottom edge of said medial portion of said face plate to partially fill said pocket, said support base having a width less than or equal to a width of said medial portion.

2. The improvement of claim 1, wherein each said mount includes a central hole defined therethrough such that said mount can be fixed to said exterior surface of said helmet using a screw or rivet.

3. The improvement claim 2, wherein each said mount is made of rubber such that said back surface is deformable to conform to said exterior surface of said helmet.

4. The improvement of claim 2, wherein each said mount is made of a rigid composite material and wherein said back surface is pre-formed to match the curvature of said helmet.

5. The improvement of claim 2, wherein said face plate includes a pair of plate holes, each said plate hole aligned with each said central hole such that said face plate can receive said screw or rivet.

6. The improvement of claim 5, wherein said face plate holes are spaced a distance equal to the distance between pre-existing helmet facemask holes such that said holder when mounted acts as a substitute for a helmet-maker label.

7. The improvement of claim 6, wherein said face plate has an outwardly displayed logo.

8. The improvement of claim 7, wherein said face plate is made of plastic.

* * * * *